United States Patent [19]

Denley

[11] Patent Number: 4,574,171

[45] Date of Patent: Mar. 4, 1986

[54] KEYBOARD AUXILIARY BEARING

[75] Inventor: Ronald S. Denley, Woodstock, Ill.

[73] Assignee: Oak Industries Inc., Rancho Bernardo, Calif.

[21] Appl. No.: 637,266

[22] Filed: Aug. 3, 1984

[51] Int. Cl.[4] ..... H01H 3/12

[52] U.S. Cl. ..... 200/340; 400/490

[58] Field of Search ..... 200/340; 400/490, 492, 400/495, 496

[56] References Cited

U.S. PATENT DOCUMENTS 3,916,150 10/1975 Abernethy et al. ..... 200/340

3,962,556 6/1976 Kravchuck ..... 400/496

OTHER PUBLICATIONS

Gaunce, S. A., "Dogleg Keybutton Guide Design-"—*IBM Tech. Disclosure,* Mar. 1984, vol. 26, No. 10A, pp. 4976–4977.

*Primary Examiner*—Stephen Marcus

*Assistant Examiner*—Renee S. Kidorf

*Attorney, Agent, or Firm*—Kinzer, Plyer, Dorn & McEachran

[57] ABSTRACT

An auxiliary bearing for use in a keyboard to prevent binding of keys having irregularly-shaped keycaps. The irregular keycap is mounted on a plunger which reciprocates in a main switch housing. The switch housing is attached to the keyboard. The keycap also has a coupler attached to its underside. The coupler engages a bearing in the form of a sleeve which supports the coupler along a portion of its length sufficient to preclude the coupler from tilting in the sleeve. The bearing member is mounted on an auxiliary housing which in turn is attached to the keyboard. The connection of the bearing to the auxiliary housing permits the bearing to shift laterally on the housing to permit alignment of the coupler and sleeve despite variations in the auxiliary housing location and the keycap location. But the bearing is prevented from tilting or skewing in the auxiliary housing by a set of cooperating hooks on the housing and bearing.

13 Claims, 5 Drawing Figures

KEYBOARD AUXILIARY BEARING

SUMMARY OF THE INVENTION

This invention relates to keyboards and is specifically concerned with the mechanical operation of the keys.

A keyboard typically has a plurality of keys which comprise a housing, a plunger reciprocative within in the housing and a keycap affixed to the top of the plunger. A set of electrical contacts is associated with the key. The contacts are arranged to operate upon actuation of the key. A return mechanism is also usually provided. One of the problems in constructing a keyboard is ensuring proper mechanical operation of keys having multi-wide or L-shaped keycaps. These irregularly-shaped keycaps present a large area which the user may contact when attempting to actuate the key. Part of this area is remotely located from the plunger. Thus, when a user depresses the key at a point not directly over the plunger, a tilting or skewing moment is generated about the plunger. So instead of moving smoothly up and down in the housing, the plunger tends to twist or tilt, causing binding of the plunger. This defeats the purpose of the wide area key as the user is not able to actuate the key by hitting it anywhere on its keycap but instead is required to contact it only in the vicinity of the plunger. At best this causes frustration and delay and it can also lead to errors in the use of the keyboard.

The present invention provides an auxiliary support which constrains the keycap to move in a direction parallel to the plunger axis of motion and prevents binding of the plunger in its housing.

Another object of the invention is an irregular key having a smooth and fluid action.

Another object of the invention is an auxiliary bearing for an irregular key, the bearing preventing tilting or skewing of the keycap.

Another object of the invention is an auxiliary support for an irregular key which can accommodate variations in the locations of the support and the irregular keycap.

Other objects will appear from time to time in the following specification and drawings.

DETAILED DESCRIPTION OF THE INVENTION

Figure 1:
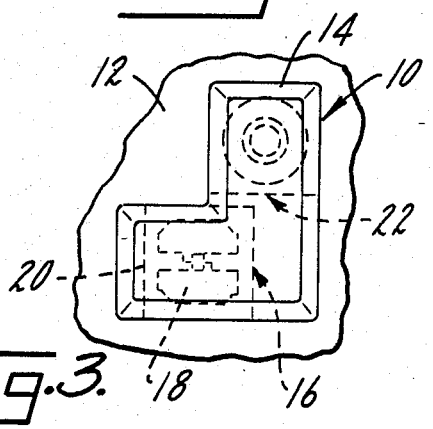
FIG. 1 is a plan view of an L-shaped key mounted on a keyboard.
Figure 2:
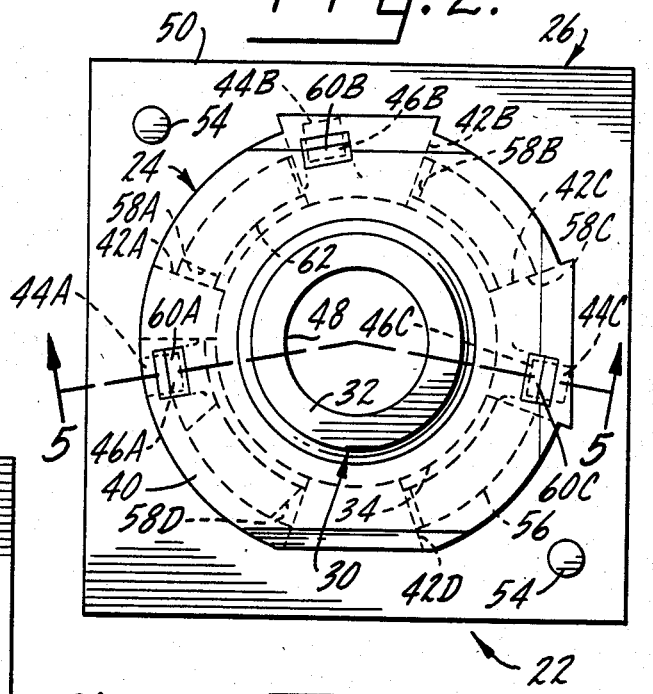
FIG. 2 is a plan view of the auxiliary support of the present invention, on an enlarged scale.
Figure 3:
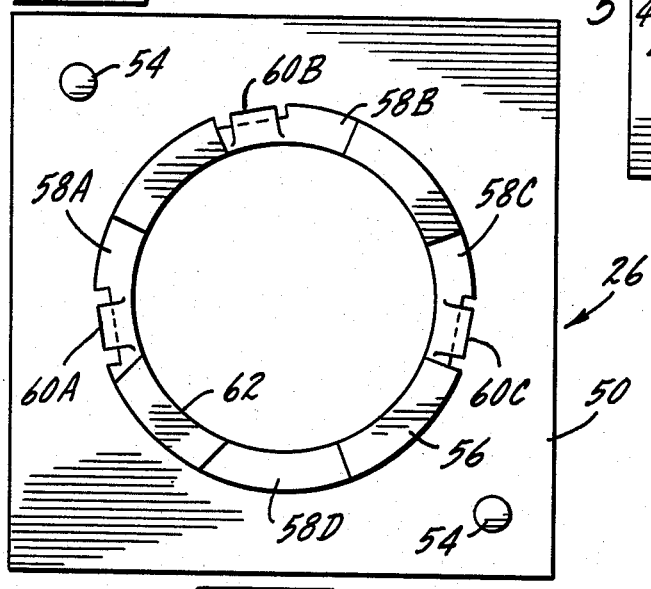
FIG. 3 is a plan view of the support housing.
Figure 4:
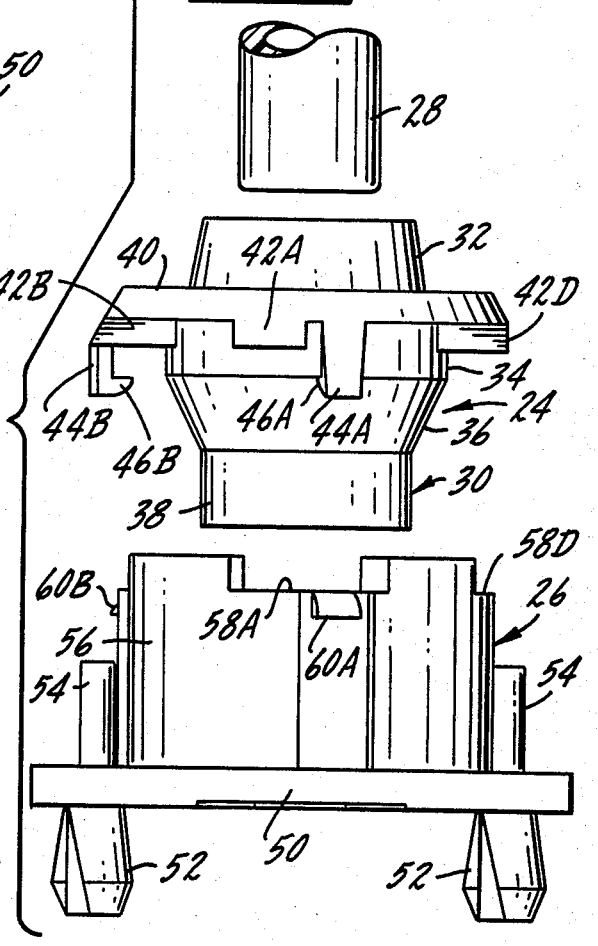
FIG. 4 is a side elevation view, with parts exploded, of the auxiliary support.

FIG. 1 illustrates an irregular key 10 mounted on a keyboard having a baseplate 12. The key has an irregularly-shaped keycap 14, in this case an L-shaped keycap. The keycap is mounted on a switch 16. The switch includes a plunger, the upper portions of which are visible at 18, which reciprocates in a main switch housing 20. The plunger reciprocates along a plunger axis of motion, which in this case is perpendicular to the plane of the baseplate. The housing is mounted on the baseplate 12. Electrical contacts (not shown) are associated with the switch 16 and are arranged to operate upon actuation of the key. Further details of a typical switch are described and claimed in application Ser. No. 553,966, filed Nov. 21, 1983 and assigned to the present assignee. The auxiliary support of the present invention is shown generally at 22. It is fixed to the baseplate 12 and connected to the keycap 14 in a manner which will be explained below.

Turning to FIGS. 2–5, details of the auxiliary support are shown. The auxiliary support 22 has two main parts; a bearing 24 and mounting means for the bearing in the form of an auxiliary housing 26. A coupling means in the form of a cylindrical, elongated peg 28 is attached to the underside of the keycap 14. The axis of the peg is parallel to the plunger axis in the main switch housing 16.

The bearing 24 includes securement means in the form of a sleeve 30. The sleeve has an upper, tapered section 32 which merges into a central, cylindrical section 34, continuing with a lower tapered section 36 and ending with a lower cylindrical section 38. Near the joint between the upper tapered portion 32 and the upper cylindrical section 34 is an outwardly extending flange 40. Four wedges labeled 42A–42D are formed on the underside of the flange 40. Also depending from the flange 40 are three fingers 44A, 44B and 44C. Finger hooks 46A, 46B and 46C project inwardly from the free ends of the fingers. The sleeve 30 has a central opening or bore 48 (FIG. 5) extending therethrough.

The auxiliary housing 26 includes a generally flat base 50 which attaches to the baseplate 12 by means of expandable rivets 52 and drive pins 54. An upstanding, circular wall 56 extends from the base 50. The top land of the wall has four cutout portions 58A–58D. There are three housing hooks 60A, 60B and 60C projecting outwardly from the exterior surface of the wall 56. The interior of the wall defines an opening 62.

The parts of the auxiliary support fit together as follows. The sleeve 30 of the bearing 24 fits in the opening 62 of the auxiliary housing 26. When the bearing is pressed into place, the finger hooks 46A–46C engage the corresponding hooks 60A–60C of the housing. The fingers 44A–44C flex outwardly to permit the finger hooks to slip past the housing hooks. When that occurs the fingers return to their normal position and the surfaces of the respective pairs of hooks engage along a plane perpendicular to the plunger axis of motion. Once the bearing is in place, the flange 40 rests on the top land of the wall 56 and the wedges 42A–42D of the flange 40 reside in the cutout portions 58A–58D of the wall 56. The interlocking arrangement of the wedges and cutouts prevents the bearing from rotating in the housing.

Figure 5:
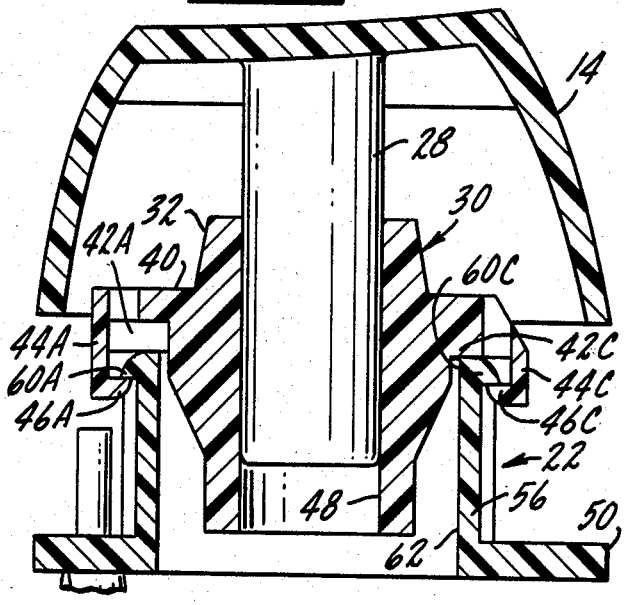
FIG. 5 is a section taken substantially along line 5—5 of FIG. 2.

It will be noted in FIG. 5 that the fingers 44A–44C extend adjacent to but are spaced from the housing hooks 60A–60C. Also, the outside diameter of the upper cylindrical portion 34 of the sleeve 30 is less than the inside diameter of the wall 56. Thus, the gap between the portion 34 and the wall 56 and the gaps between the fingers 44 and the housing hooks 60 provide a tolerance float. Also, the cooperating surfaces of the finger and housing hooks allow the bearing to shift laterally relative to the housing. That is, the bearing can shift in a plane perpendicular to the plunger axis of motion. However, the cooperating pairs of hooks prevent the bearing from tilting or skewing in a plane parallel to the plunger axis of motion. So the bearing can shift or slide laterally but it cannot tilt or skew. In terms of the specific embodiment shown, the axis of the sleeve opening 48 will always remain vertical.

The coupling means of the keycap 14, namely the peg 28, fits in the bearing opening 48 with minimal clearance. The peg and opening have a close tolerance fit so that the peg is supported along a portion of its length sufficient to prevent skewing of the peg in the opening. The peg is free to move up and down with the keycap but it is constrained by the bearing to move only in a vertical direction. The tolerance float of the bearing on the support housing permits adjustment of the bearing position so that the opening 48 can be aligned with the peg 28. This is necessary because there will be some variation or tolerance in the location of the housing 22 on the keyboard 12 and also in the location of the peg 28. With the tolerance float in the auxiliary support these tolerances are compensated for while simultaneously limiting motion of the keycap to a vertical direction.

It can be seen that the auxiliary support of the present invention will prevent skewing or tilting of the plunger 18 in the main switch housing 20 and thus will allow the key to move smoothly and fluidly.

It will be realized that while a specific form of the invention has been shown and described, there may be many modifications, alterations and changes made therein without departing from the scope of the following claims.

I claim:

1. In a keyboard having at least one irregularly-shaped keycap mounted on a plunger which is reciprocative along an axis of motion in a main switch housing, the irregular keycap having coupling means attached to its underside, an auxiliary support for preventing binding of the plunger, comprising a bearing having securement means for engaging the coupling means, the securement means allowing relative motion between the bearing and the keycap only in a direction parallel to the plunger axis of motion, and mounting means for attaching the bearing to the keyboard such that the bearing can shift in a plane perpendicular to the plunger axis of motion but cannot skew in a plane parallel to the plunger axis of motion.

2. The structure of claim 1 wherein the coupling means is a peg having an axis parallel to the plunger axis, and the securement means includes a sleeve having an opening which receives the peg and contacts the peg along a portion of its length sufficient to prevent skewing of the peg.

3. The structure of claim 2 wherein the peg fits in the sleeve opening with a close tolerance.

4. The structure of claim 2 wherein the peg and sleeve opening are cylindrical.

5. The structure of claim 1 wherein the bearing has a plurality of surfaces engaging cooperating surfaces of the mounting means along a plane perpendicular to the plunger axis of motion.

6. The structure of claim 1 wherein the mounting means comprises an auxiliary housing fixed to the keyboard.

7. The structure of claim 6 wherein the auxiliary housing includes a plurality of hooks and the bearing has a plurality of hooks contacting the housing hooks along a plane perpendicular to the plunger axis of motion.

8. The structure of claim 7 wherein the auxiliary housing includes an upstanding, circular wall with the housing hooks projecting radially therefrom.

9. The structure of claim 8 wherein the bearing has a plurality of fingers with the bearing hooks projecting therefrom, the fingers extending adjacent to but spaced from the housing hooks.

10. The structure of claim 9 wherein the bearing includes a sleeve which fits within the housing wall, and a flange connected to the sleeve and engaging the top land of the wall, the fingers depending from the flange.

11. The structure of claim 10 wherein the flange extends beyond the wall and the fingers are outside the wall with the finger hooks projecting inwardly toward the wall to engage the outwardly projecting housing hooks.

12. The structure of claim 10 wherein the top land of the wall has cutout portions and the flange has depending wedges which fit in the cutout portions of the wall.

13. The structure of claim 1 wherein the irregular keycap is L-shaped.

* * * * *